United States Patent [19]

Hovan

[11] 4,025,226

[45] May 24, 1977

[54] AIR COOLED TURBINE VANE

[75] Inventor: Edward John Hovan, Manchester, Conn.

[73] Assignee: United Technologies Corporation, Hartford, Conn.

[22] Filed: Oct. 3, 1975

[21] Appl. No.: 619,558

[52] U.S. Cl. ..... 415/115; 416/97 A

[51] Int. Cl.[2] ..... F01D 5/18

[58] Field of Search ..... 415/115, 116; 416/96 A, 416/96, 97; 417/97

[56] References Cited

UNITED STATES PATENTS

| | | | |
|---|---|---|---|
| 2,847,185 | 8/1958 | Petrie et al. | 415/116 |
| 2,888,243 | 5/1959 | Pollock | 416/96 A |
| 3,369,792 | 2/1968 | Kraimer et al. | 416/97 |
| 3,388,888 | 6/1968 | Kercher et al. | 416/97 |
| 3,420,502 | 1/1969 | Howald | 415/115 |
| 3,628,880 | 12/1971 | Smuland et al. | 415/115 |
| 3,807,892 | 4/1974 | Frei et al. | 415/116 |

*Primary Examiner*—Henry F. Raduazo
*Attorney, Agent, or Firm*—Robert C. Walker

[57] ABSTRACT

A stator vane capable of use in the high temperature environment of a gas turbine engine is disclosed. Various construction details implement vane cooling concepts which are designed to prolong the service life of the vane. An effective leading edge cooling system is built around the uniform flow of film cooling air over the exterior surface of the leading edge from a cavity within the airfoil section of the vane.

7 Claims, 5 Drawing Figures

AIR COOLED TURBINE VANE

BACKGROUND OF THE INVENTION

1. Field of the Invention

The present invention relates to gas turbine engines and more particularly to stator vanes for use in engines having high turbine inlet temperatures.

2. Description of the Prior Art

The design and construction of gas turbine engines has always required precise engineering effort to ensure the structural integrity of the individual components. One particularly critical area for concern is the turbine nozzle which is formed of a plurality of vanes disposed across the flow path for the high temperature gases in the turbine. During operation of the engine, the flowing gases are redirected by the nozzle onto the rotor blades of a turbine wheel. The temperature of the gases at the inlet to the turbine normally exceeds the allowable temperature limit of the material from which the vanes are fabricated. Consequently, the vanes are cooled to prolong their service life by reducing the metal temperature of the vanes during operation.

Cooling air to the vanes is supplied by the compressor section of the engine. The air is flowed through various conduit means both inwardly and outwardly of the working medium gas path to the turbine section of the engine. A hollow cavity within the airfoil section of each vane receives the cooling air. Air entry ports at both ends of the hollow cavity are in communication with the conduit means. A typical vane utilized in cooled turbines is shown in U.S. Pat. application Ser No. 531,632 entitled, "Cooled Turbine Vanes" by Leogrande et al, of common assignee herewith. In Leogrande et al an insert is disposed within a hollow cavity at the leading edge of a vane airfoil section. The insert is positioned to direct adequate quantities of cooling air to the leading edge of the airfoil section for film cooling.

Film cooling requires a precise but relatively low pressure differential across flow emitting holes. If the pressure drop is too high, the emitted flow penetrates the passing medium and is deflected downstream with the combustion gases without establishing a film layer on the airfoil surface. On the other hand, if the pressure drop is too small, the hot combustion gases penetrate the cooling air layer to cause destructive heating of the vane material. Because the pressure differential between the cooling air within the vane cavity and the working medium gases at the vane leading edge is relatively small, the amount of flow through each hole is highly sensitive to local pressure deviations within the cavity.

To implement uniform film cooling at the leading edge of the airfoil section, the local pressure deviations in the hollow cavity must be reduced or eliminated. Continuing efforts toward that end are being made.

SUMMARY OF THE INVENTION

A primary aim of the present invention is to provide a coolable vane having improved service life. In one aspect, an object is to eliminate the back flow of working medium gases into the vane cooling system. Apparatus capable of providing a nearly uniform flow of cooling air to the leading edge of each vane is sought. One goal in sustaining uniform flow is the establishment of a substantially uniform pressure differential across the leading edge of the vane between the working medium gases of the flow path and the cooling air of the vane cavity.

The present invention is predicated upon the recognition that the cross flow of cooling air from one end of a hollow vane cavity to the other creates local pressure deviations at the various film cooling holes of the leading edge. More specifically, under certain engine operating conditions the cooling air supplied to one end of the cavity overrides the air supplied to the opposing end. The velocity of the air entering the end of the dominant supply becomes excessive and aspiration of the hot working medium gases into the hollow cavity through the film cooling holes results.

According to the present invention a mid-span baffle is operatively disposed within the hollow cavity of a coolable turbine vane, having entry ports for cooling air at both the inner and outer ends of the vane, to prevent the cross flow of air from one end to the other.

A primary feature of the present invention is the mid-span position of the baffle. In one embodiment the baffle is suspended from a U-shaped insert which brackets the leading edge cooling holes. In the same embodiment the baffle loosely engages one or more corresponding openings in the U-shaped insert to position the baffle within the cavity without inhibiting the lateral deflection of the insert in response to pressure forces within the insert.

A principal advantage of the present invention is the prolonged service life obtainable through incorporation of the mid-span baffle. Local burning of the vane material is prevented by eliminating the aspiration of hot working medium gases into the cooling cavity. A reduction in the cooling air pressure required to ensure a positive flow of cooling air through the leading edge holes enables an improvement in overall engine efficiency.

The foregoing, and other objects, features and advantages of the present invention will become more apparent in the light of the following detailed description of the preferred embodiment thereof as shown in the accompanying drawing.

DESCRIPTION OF THE PREFERRED EMBODIMENT

Figure 1:
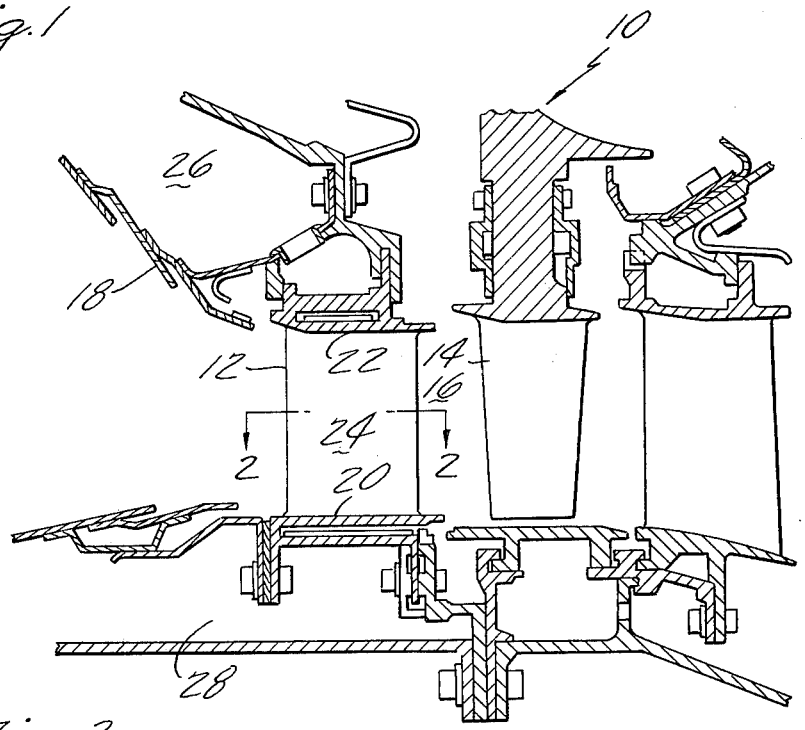
FIG. 1 is a simplified cross section view of a portion of a gas turbine engine showing a vane at the inlet to the turbine.

The turbine section 10 of a typical gas turbine engine is shown in partial cross section in FIG. 1. A stator vane 12 and a rotor blade 14 are disposed across an annular flow path 16 for the working medium gases discharging from a combustion chamber 18 during operation of the engine. The stator vane shown is one of a row of vanes which are located at the same axial position within a flow path. Similarly, the turbine blade shown is one of a row of turbine blades disposed within the flow path immediately downstream of the vanes. Each vane has an outer diameter base 20 and an inner diameter base 22 which support an airfoil section 24 extending therebetween. Each vane is coolable and is adapted to receive relatively low temperature air flowing from an inner annulus 26 and an outer annulus 28 in the turbine section.

Figure 2:
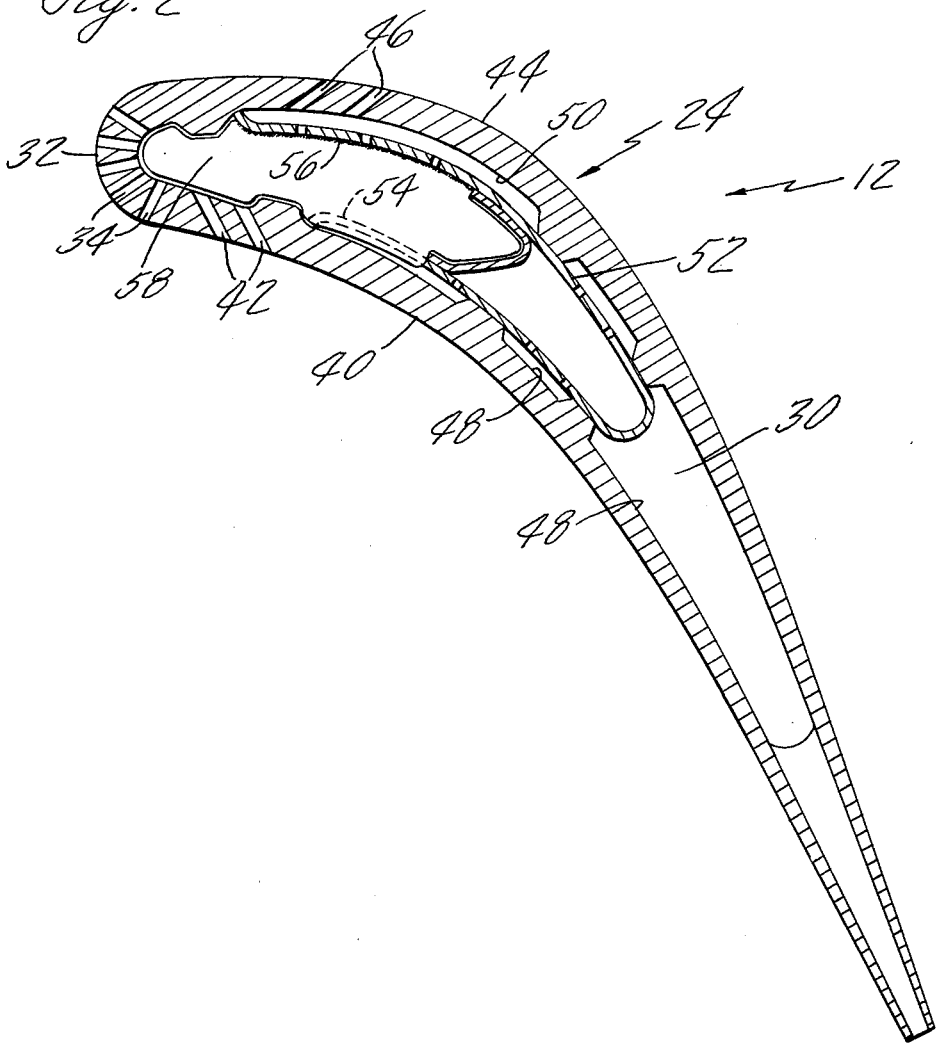
FIG. 2 is a sectional view of the turbine vane taken along the line 2—2 as shown in FIG. 1.
Figure 3:
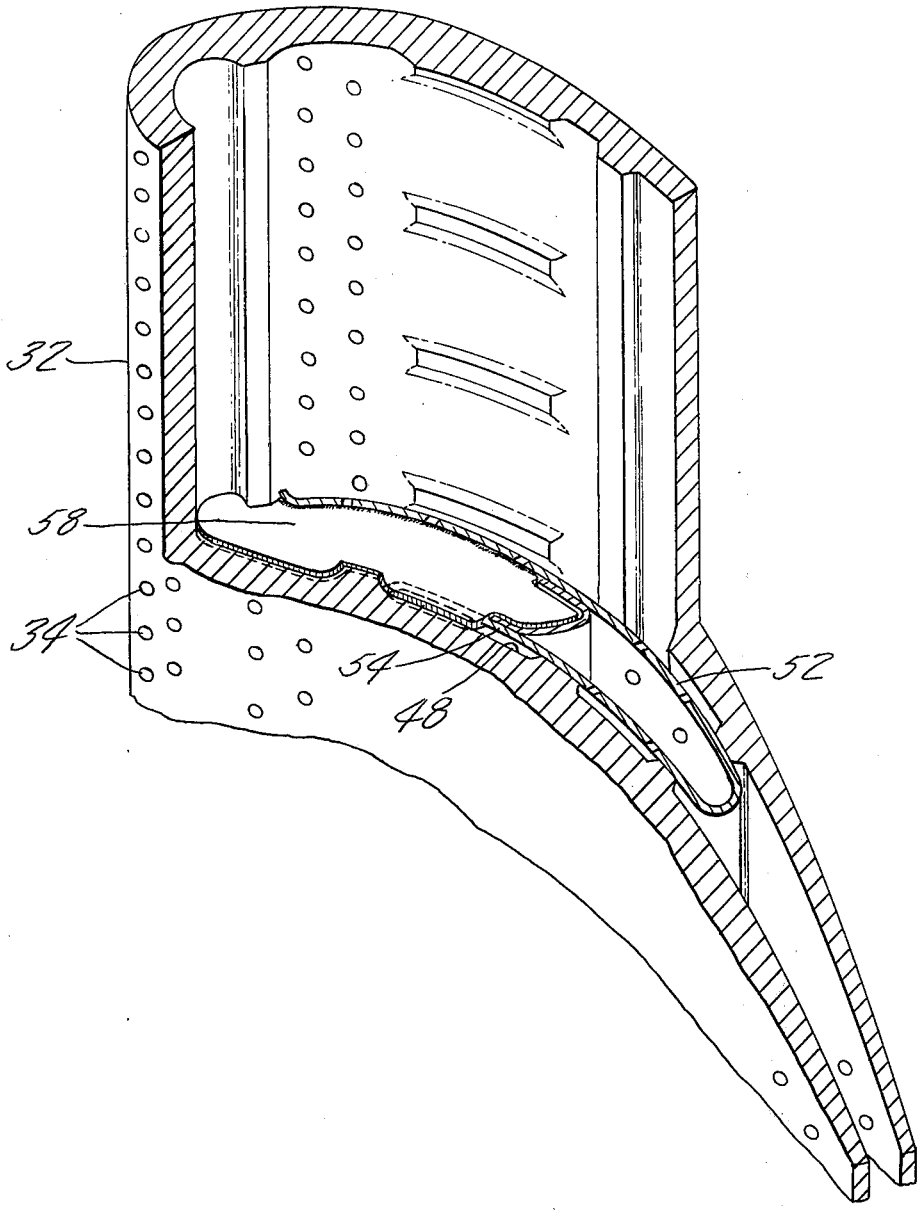
FIG. 3 is a partially broken away, perspective view of the vane shown in FIG. 2.

The FIG. 2 sectional view reveals, extending in a spanwise direction between the inner and outer bases of the airfoil section, a cavity 30 which receives cooling air from the inner and outer annuli. The airfoil section 24 has a leading edge 32 which faces in the upstream direction with respect to flow through the path 16 and has incorporated therein a plurality of leading edge cooling holes 34. A trailing edge 36 having one or more passages 38 faces in the downstream direction with respect to the direction or working medium flow. A pressure side 40 of the airfoil section has a plurality of pressure side cooling holes 42; a suction side 44 of the airfoil section has a plurality of suction side cooling holes 46. The cavity 30 is formed by a pressure wall 48 and a suction wall 50. An insert 52, which is substantially U-shaped, is disposed within the cavity and extends in the spanwise direction between the inner and outer bases. The insert has a pressure leg 54 and a suction leg 56 and is fabricated of a flexible material such as sheet metal. The flexible insert is deformable against the pressure and suction walls of the cavity in operative response to increased pressure within the insert. A baffle 58 is suspended between the suction leg and the pressure leg of the U-shaped insert at a mid-span position within the cavity. The baffle loosely engages the pressure leg of the insert in a manner radially supporting the baffle without inhibiting the deflection of the pressure and suction legs of the insert against the respective pressure and suction walls of the cavity dirring operation. As is shown in FIGS. 2 and 3, the baffle is welded to the suction leg of the insert; in alternate embodiments loose engagement means corresponding to that shown at the pressure leg of the insert may be effectively employed.

Figure 4:
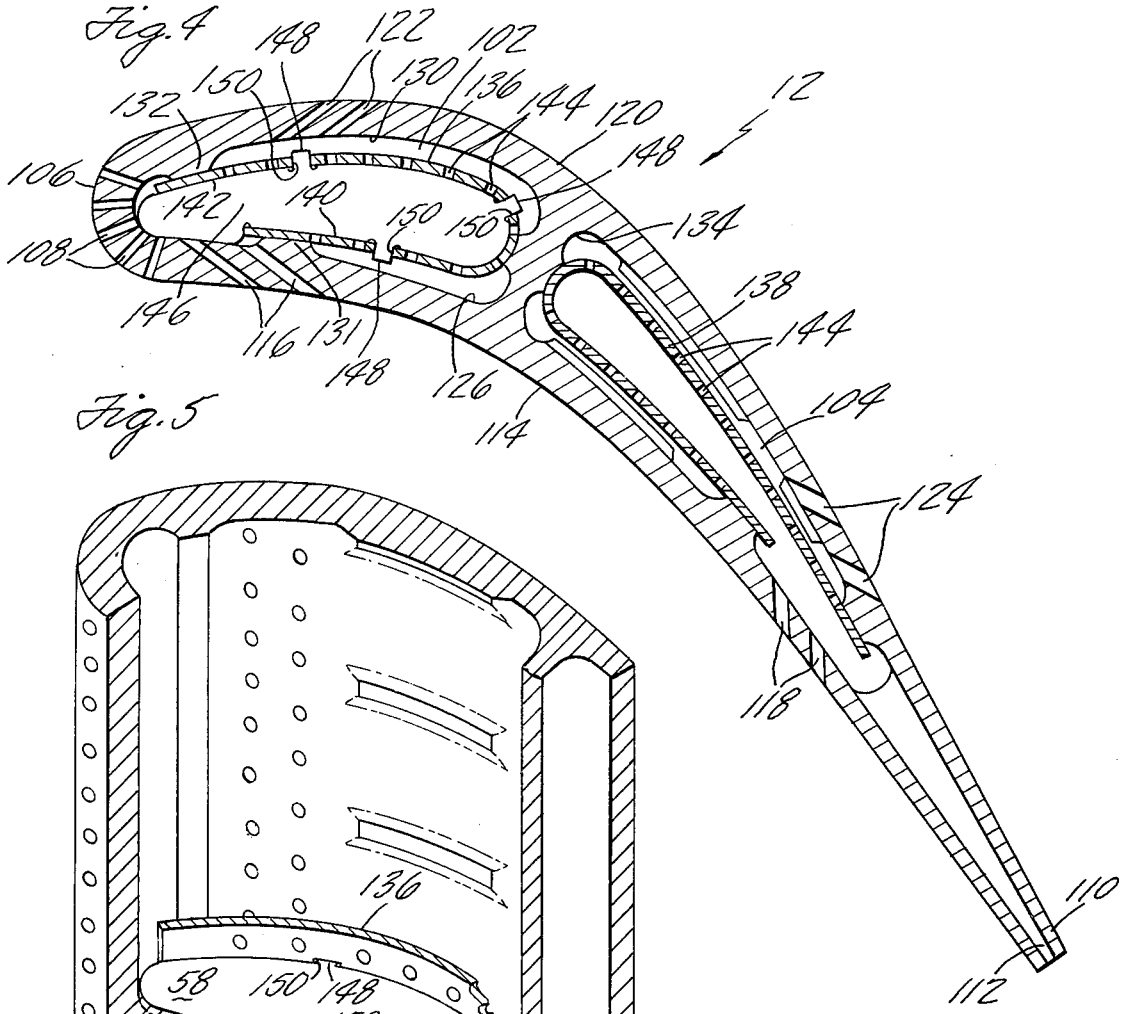
FIG. 4 is a sectional view of the turbine vane showing an alternate internal construction.

An alternate internal construction for the hollow vane 12 is shown in FIG. 4 wherein the hollow portion is comprised of a leading edge cavity 102 and a trailing edge cavity 104. A leading edge 106 faces in the upstream direction and has incorporated therein a plurality of leading edge cooling holes 108. A trailing edge 110 faces in the downstream direction and has incorporated therein a passage 112. Each vane has a pressure side 114 which includes a first plurality of pressure side cooling holes 116 extending from the leading edge cavity 102 to the annular flow path and a second plurality of pressure side cooling holes 118 extending from the trailing edge cavity 104 to the annular flow path. Each airfoil section further has a suction side 120 including a first plurality of suction side holes 122 extending between the leading edge cavity and the flow path and a second plurality of suction side cooling holes 124 extending between the trailing edge cavity 104 and the annular flow path.

The leading edge cavity 102 is bounded by a pressure wall 126 and a suction wall 130 which have correspondingly a pressure wall sealing rib 131 and a suction wall sealing rib 132 extending therefrom. The leading and trailing edge cavities are separated by a cross member 134. A leading edge insert 136 and a trailing edge insert 138 have substantially U-shaped contours and are disposed within the leading edge cavity and trailing edge cavity respectively. Each insert has a pressure leg 140 which opposes the pressure wall of the respective cavity and a suction leg 142 which opposes the suction wall of the respective cavity. Impingement cooling holes 144 penetrate the leading and trailing edge inserts.

A baffle 146 is suspended between the suction and pressure legs of the U-shaped insert in the leading edge cavity. In the embodiment shown the baffle has a plurality of tabs 148 which loosely engage corresponding apertures 150 in the leading edge insert so as to position the baffle at a mid-span location with respect to the airfoil. The loose engagement between the baffle and the insert allows radial support of the baffle without inhibiting lateral deflection of the insert pressure and suction legs in response to increased pressure within the insert.

During operation of the engine, cooling air is flowed to the inner annulus 26 and to the outer annulus 28. The pressure differentials between the air in the two annuli and the medium gases of the flow path 16 are dependent upon the frictional flow losses en route to the respective annuli and upon the pressure drop established across the combustion chamber. Under operating conditions wherein the pressure of the gases in one of the annuli is greater than that in the opposing annuli, a cross flow of cooling air through the cavity 30 of the vane 24 occurs in the direction of the annulus having lower pressure. In a cross flow condition, then, the entire supply of cooling air to the leading holes 34 flows from the annulus having the dominant supply. Furthermore, the volume of the air entering the cavity 30 is increased beyond that flowed through the holes 34 to include the amount of cross flow air discharged into the opposing annulus. Under such a condition the flow velocities of air through the cavity may become excessive and cause aspiration of the working medium gases through the holes 34 into the cavity 30.

The baffle 58 of the present invention is disposed at a mid-span location within the cavity 30. The baffle prevents the cross flow of cooling between the two opposing supply annuli to significantly decrease the possibility of aspiration through the holes 34. Although the baffle is shown at the approximate geometric center of the airfoil section, it may be desirable to locate the baffle radially inward or outward within the cavity 30. A change in the radial position of the baffle within the mid-span region is desirable where the pressure of the cooling air in one of the annuli is known to be greater than that in the other. In such a case the baffle is adjusted in the direction of the annuli having a lesser supply pressure and can be so relocated without permitting cross flow.

The elimination of the potential for cross flow has the beneficial effect of lowering the required pressure differential between the cooling air and the working medium gases of the flow path 16 which is necessary to ensure that aspiration does not occur. Inasmuch as the pressure differential required to prevent aspiration is functionally derived from the pressure drop across the combustion chamber, any decrease in the required differential enables a corresponding reduction in combustion chamber flow losses. An improvement in overall engine efficiency results.

An insert, such as the insert 52 of FIG. 2 or the insert 136 of FIG. 4, is disposed within the respective cavity 30 or 102 to isolate the film cooling holes of the leading edge from the remainder of the cavity. Isolation ensures a positive flow of cooling air through the holes to the medium flow path in a region of highest pressure and temperature. The insert 52, which has a substantially U-shaped contour, brackets the leading edge holes 38 and the pressure side cooling holes 42 of the airfoil section shown in FIG. 2. Although the pressure side cooling holes are not provided in some constructions, the holes are incorporated in the preferred embodiment shown to increase the thickness of the boundary layer of film cooling air along the pressure side of the airfoil. The pressure side holes are isolated along with the leading edge holes in order to take advantage of the controlled flow provided at the leading edge holes by the apparatus constructed in accordance with the present invention.

In response to increased pressure within the insert as cooling air is flowed thereto, the pressure leg 54 and the suction leg 56 of the insert are deflected within the cavity 30 against the pressure wall 58 and the suction wall 50 respectively. This lateral deflection is uninhibited by the mid-span baffle 58 which loosely engages the insert. In one embodiment the baffle is welded to the suction leg 56 of the insert and loosely engages the pressure leg 54 of the insert, although a baffle loosely engaging both legs of the insert is equally effective. It is important to note, however, that both the suction and pressure legs are not structurally tied to the baffle and free lateral deflection of the insert legs is permitted.

Figure 5:
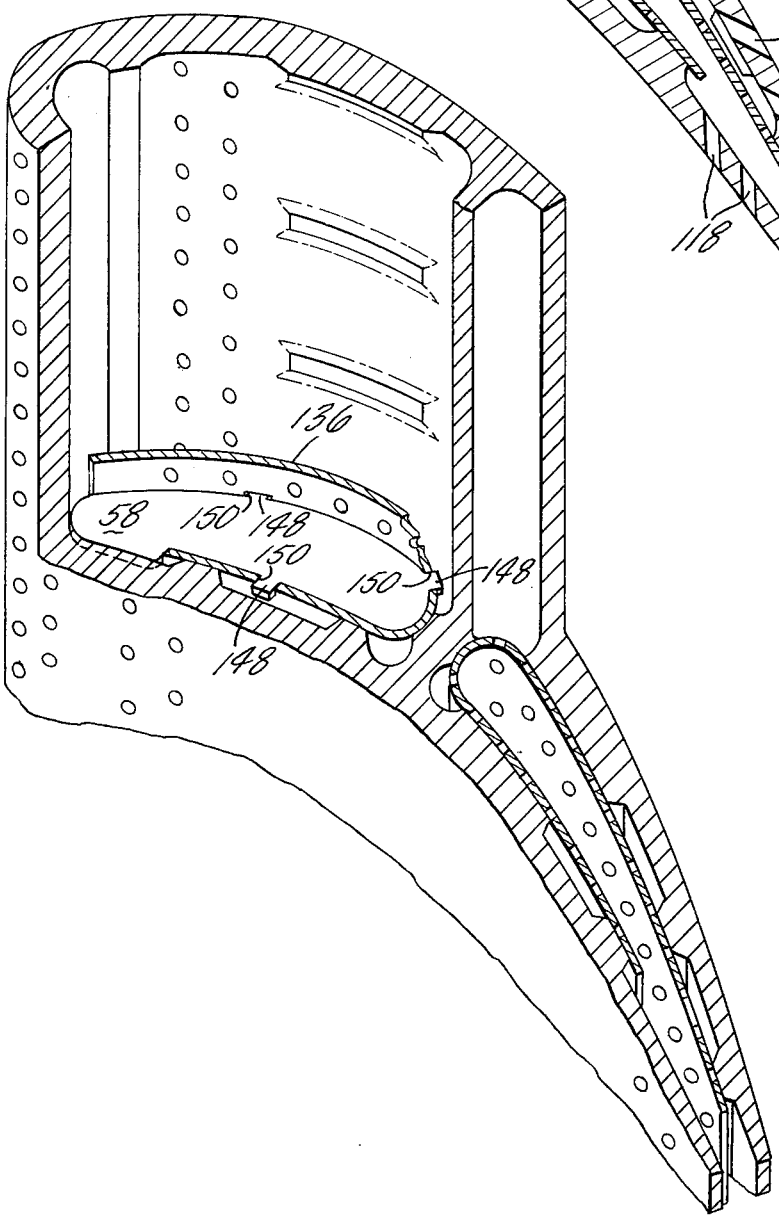
FIG. 5 is a partially broken away, perspective view of the turbine vane shown in FIG. 4.

In the alternate embodiment shown in FIG. 5, the baffle has a plurality of tabs 148 which loosely engage corresponding apertures 150 of the leading edge insert 136. As in a prior discussed construction, the baffle may be fixedly attached to either the pressure leg or the suction leg of the inserts without departing from the concepts taught herein.

Although the invention has been described with respect to a preferred embodiment, it should be understood by those skilled in the art that various changes and omissions in the form and detail thereof may be made therein without departing from the spirit and the scope of the invention.

Having thus described a typical embodiment of my invention, that which I claim as new and desire to secure by Letters Patent of the United States is:

1. In a turbine vane having a spanwise extending cavity into which cooling air is flowable from opposing ends of the cavity and having a leading edge which has incorporated therein means for distributing cooling air from the cavity over the exterior surface of the leading edge, the improvement comprising:

a baffle disposed within the cavity at a substantially mid-span location for reducing the local velocity of the entering cooling air by preventing the cross flow of cooling air from one end of the cavity to the other.

2. The invention according to claim 1 wherein said air distribution means are holes disposed along the leading edge of the vane and wherein the invention further includes a U-shaped insert which isolates the holes from the remainder of the cavity.

3. The invention according to claim 2 wherein said baffle is disposed within the U-shaped insert and is loosely positioned thereby while leaving said insert free for lateral deflection against the walls of the cavity.

4. The invention according to claim 3 wherein the insert has at least one aperture in the mid region thereof and wherein said baffle has a corresponding number of tabs which loosely engage the apertures of the insert.

5. The invention according to claim 3 wherein the U-shaped insert has a pressure leg and a suction leg and wherein said baffle is fixedly attached to one of said legs and is loosely engaged by the other of the legs.

6. The invention according to claim 1 wherein said cavity is disposed at the leading edge of the turbine vane which further has a trailing edge cavity which is isolated from said leading edge cavity.

7. An method for cooling the leading edge of a turbine stator vane comprising the steps of:

flowing cooling air from the compressor section of the engine to an inner annulus;

flowing cooling air from the compressor section of the engine to an outer annulus;

flowing said cooling air from the inner annulus to a first set of holes at the leading edge of the vane;

flowing said cooling air from the outer annulus to a second set of holes at the leading edge of the vane which are isolated from said first set of holes by a baffle within the vane.

* * * * *